US008163370B2

(12) United States Patent
Kuo

(10) Patent No.: US 8,163,370 B2
(45) Date of Patent: Apr. 24, 2012

(54) BUFFER DEVICE PROVIDING RELIABLE BUFFER EFFECT

(75) Inventor: Sheng-Hsi Kuo, Hsinchu (TW)

(73) Assignee: Gwo Shi Packing Co., Ltd., Hsinchu (TW)

( * ) Notice: Subject to any disclaimer, the term of this patent is extended or adjusted under 35 U.S.C. 154(b) by 333 days.

(21) Appl. No.: 12/694,280

(22) Filed: Jan. 27, 2010

(65) Prior Publication Data

US 2011/0183089 A1 Jul. 28, 2011

(51) Int. Cl.
*B65D 25/26* (2006.01)
*B65D 85/30* (2006.01)

(52) U.S. Cl. ..... 428/122

(58) Field of Classification Search ..... 428/122; 206/453, 586; 220/732; 248/345.1
See application file for complete search history.

(56) References Cited

U.S. PATENT DOCUMENTS

2003/0111383 A1* 6/2003 Qiu et al. ..... 206/586
* cited by examiner

*Primary Examiner* — Alexander Thomas
(74) *Attorney, Agent, or Firm* — CKC & Partners Co., Ltd.

(57) ABSTRACT

A buffer device providing reliable buffer effect includes a channel-shaped buffer member and at least one first reinforcing tubular member. The channel-shaped buffer member is a substantially U-sectioned hollow member and includes two facing inner sidewalls, two opposing outer sidewalls, an inner bottom wall, two outer top walls and an outer bottom wall to enclose a third buffer space therein. The first reinforcing tubular member is received in the third buffer space and encloses a first buffer space therein. The first reinforcing tubular member includes at least one normal-direction supporting wall extended between and pressed against the inner and outer bottom walls and provided with at least one second curved buffer section. The normal-direction supporting wall and the second curved buffer section thereof not only give the channel-shaped buffer member an increased normal-direction supporting strength, but also buffer impact force and compressing force applied normal to the outer bottom wall.

9 Claims, 6 Drawing Sheets

BUFFER DEVICE PROVIDING RELIABLE BUFFER EFFECT

FIELD OF THE INVENTION

The present invention relates to a buffer device, and more particularly to a buffer device that provides stable and reliable supporting and buffer effect to protectively package an object.

BACKGROUND OF THE INVENTION

Some fragile articles, such as screen panels, tend to become damaged on the way of delivery or in the process of handling. To avoid undesirable damage, these fragile articles are usually externally packaged with some buffer packaging material. With a buffer effect provided by the buffer packaging material between the articles and a packing box holding the articles therein, the articles are avoided from any external impact forces directly applied thereon and accordingly protected against damage caused by such impact forces.

Conventionally, the buffer packaging material is made of a foaming material or other polymeric materials. The buffer packaging material removed from the protected articles is usually no longer usable and discarded. Since the buffer packaging material made of foaming material has bulky volume and is non-biodegradable, it would cause serious environmental pollution.

To overcome the problems with the conventional bulky and non-biodegradable buffer packaging material, a paper-tube buffer device has been developed and introduced into market.

FIG. 1 is a perspective view of a conventional paper-tube buffer device 600, which is a substantially U-sectioned hollow channel having a U-shaped inner wall 610, a U-shaped outer wall 620, and a hollow space 630 enclosed in between the inner and the outer wall 610, 620. The U-shaped inner wall 610 serves to clamp on an edge portion of an article to be protectively packaged, and the U-shaped hollow space 630 serves as a buffer space to buffer impact forces or compressing forces applied to the U-shaped outer wall 620, so as to achieve the purpose of protecting the article against damage.

The conventional paper-tube buffer device 600 utilizes the hollow space 630 as a buffer space. However, the paper tube for forming the buffer device 600 has limited compression resistance, and tends to become deformed under compression when a relatively high compressing force or impact force is applied on the paper-tube buffer device 600 to thereby cause damage to the protected article.

SUMMARY OF THE INVENTION

It is therefore a primary object of the present invention to provide a stable and reliable buffer device that provides high compression resistance and can therefore buffer a relatively large impact force to protect an object being packaged with the buffer device.

Another object of the present invention is to provide a stable and reliable buffer device that has good applicability.

To achieve the above and other objects, the buffer device according to the present invention includes a channel-shaped buffer member and at least one first reinforcing tubular member. The channel-shaped buffer member has two facing inner sidewalls; two opposite outer sidewalls respectively provided with at least one first curved buffer section extended in a lengthwise direction of the channel-shaped buffer member; an inner bottom wall connected at two opposite longitudinal edges to lower edges of the two inner sidewalls, so that an elongated channel is formed between the inner bottom wall and the two inner sidewalls for receiving the edge portion of the object to be protectively packaged therein; two outer top walls connected at respective inner longitudinal edge to upper edges of the two inner sidewalls and at respective outer longitudinal edge to upper edges of the two outer sidewalls; and an outer bottom wall connected at two opposite longitudinal edges to lower edges of the two outer sidewalls. The two inner sidewalls, the two outer sidewalls, the inner bottom wall, the two outer top walls and the outer bottom wall together enclose and define a third buffer space therein. The first reinforcing tubular member is received in the third buffer space and encloses a first buffer space therein. The first reinforcing tubular member includes at least one normal-direction supporting wall extended between and pressed against the inner bottom wall and the outer bottom wall; and the normal-direction supporting wall is provided with at least one second curved buffer section extended in a lengthwise direction of the first reinforcing tubular member. With the normal-direction supporting wall of the first reinforcing tubular member extended between and pressed against the inner bottom wall and the outer bottom wall of the channel-shaped buffer member and the second curved buffer section provided on the normal-direction supporting wall, the channel-shaped buffer member can have increased normal-direction supporting strength and compression resistance to the force applied normal to the outer bottom wall, and can therefore effectively and reliably protect the object being protectively packaged with the buffer device of the present invention.

The buffer device according to an embodiment of the present invention further includes two stoppers being separately fixedly mounted to two opposite ends of the elongated channel of the channel-shaped buffer member, so that the object to be protectively packaged is confined in the elongated channel without moving sidewardly between the two stoppers.

According to an embodiment of the present invention, the first reinforcing tubular member is more than one to include a left and a right reinforcing tubular member. The left and right reinforcing tubular members are received in the third buffer space to separately locate in a left half space and a right half space of the third buffer space, so as to cooperatively provide the channel-shaped buffer member with an increased normal-direction supporting strength and to buffer impact force and compressing force applied normal to the outer bottom wall, so as to achieve the effect of stably and reliably protecting the article being packaged.

According to an embodiment of the present invention, the left and the right reinforcing tubular member respectively include at least one first horizontal supporting wall. The first horizontal supporting walls on the left and right reinforcing tubular members adjoin to each other at their longitudinal inner edges and have longitudinal outer edges separately pressed against the two outer sidewalls of the channel-shaped buffer member, and are respectively provided with at least a third curved buffer section extended in a lengthwise direction of the left and the right reinforcing tubular member. Thus, the first horizontal supporting walls and the third curved buffer sections thereof together provide the channel-shaped buffer member with increased sideward supporting strength, and buffer impact forces and compressing forces applied normal to the two outer sidewalls.

According to an embodiment of the present invention, the buffer device further includes two opposite second reinforcing tubular members received in the third buffer space at two opposite sides of the elongated channel to respectively locate between two adjacent inner sidewall and outer sidewall. Each of the second reinforcing tubular members encloses a second buffer space therein and includes a second horizontal supporting wall extended between and pressed against the adjacent inner sidewall and outer sidewall. And, each of the second horizontal supporting walls has a fourth curved buffer section extended in a lengthwise direction of the second reinforcing tubular member. The second reinforcing tubular members and the fourth curved buffer sections provided thereon together give the channel-shaped buffer member an increased horizontal supporting strength, and buffer impact forces and compressing forces applied normal to the two outer sidewalls.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
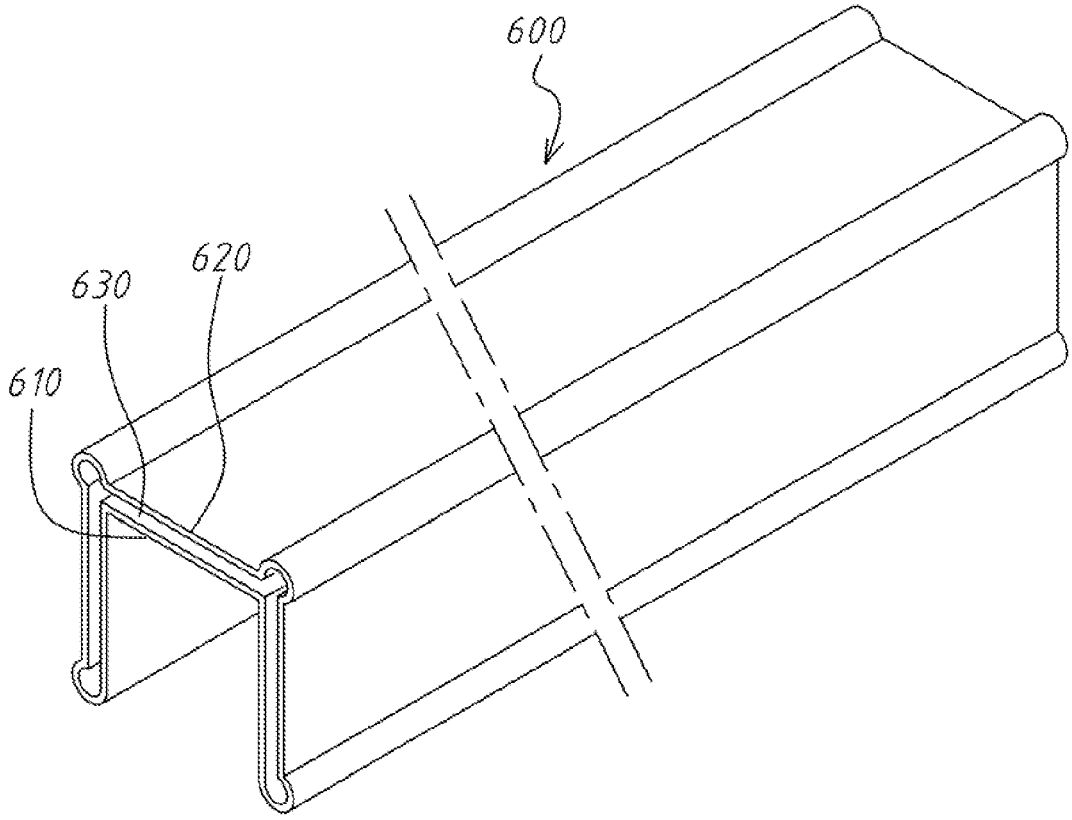
Fig. 1 (PRIOR ART)
FIG. 1 is a perspective view of a conventional paper-tube buffer device.

The present invention will now be described with some preferred embodiments thereof. For the purpose of easy to understand, elements that are the same in the preferred embodiments are denoted by the same reference numerals.

Figure 2:
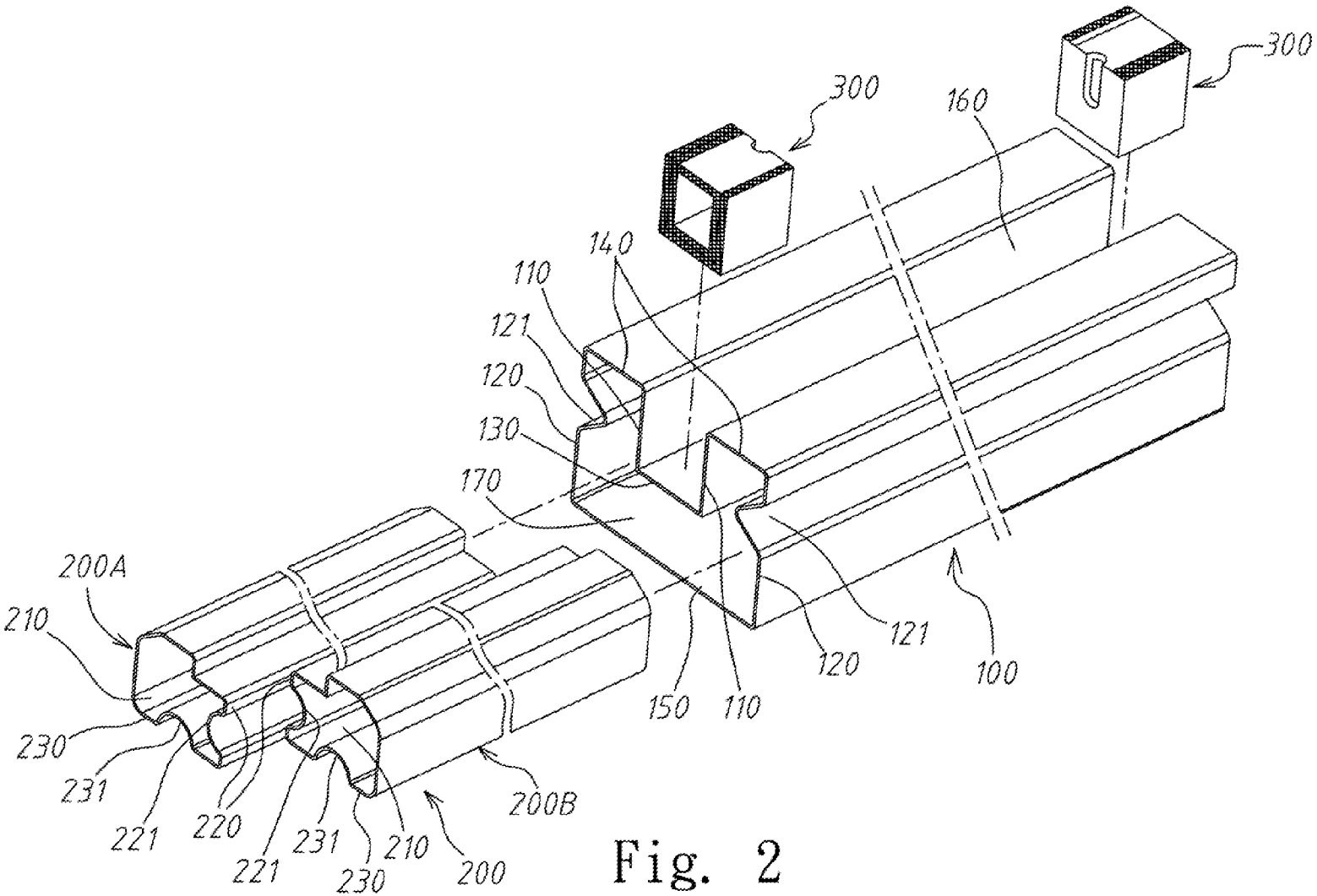
FIG. 2 is an exploded perspective view of a buffer device providing reliable buffer effect according to a first embodiment of the present invention.
Figure 3:
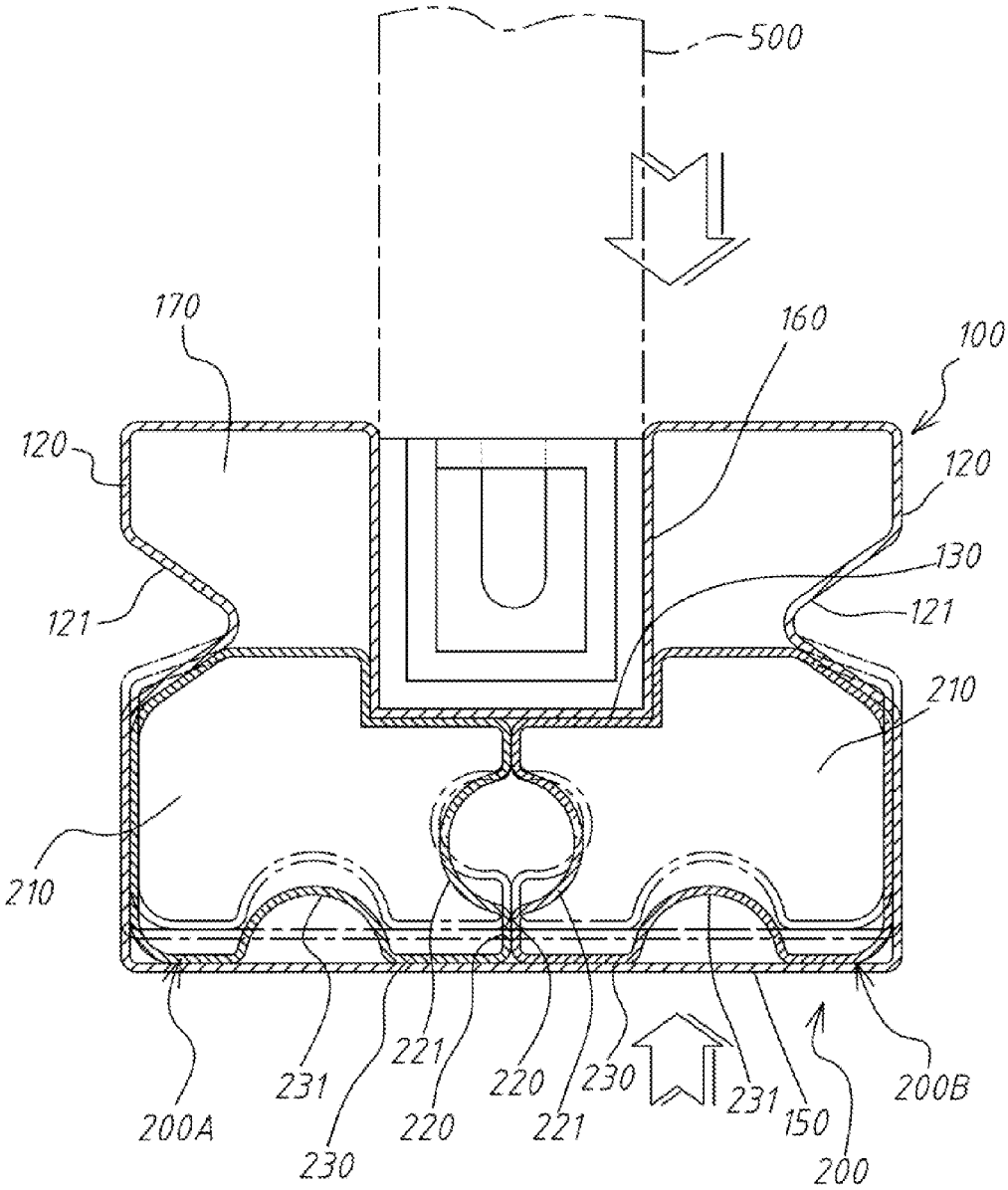
FIG. 3 is a sectioned end view of the buffer device of FIG. 2 in an assembled state.
Figure 4:
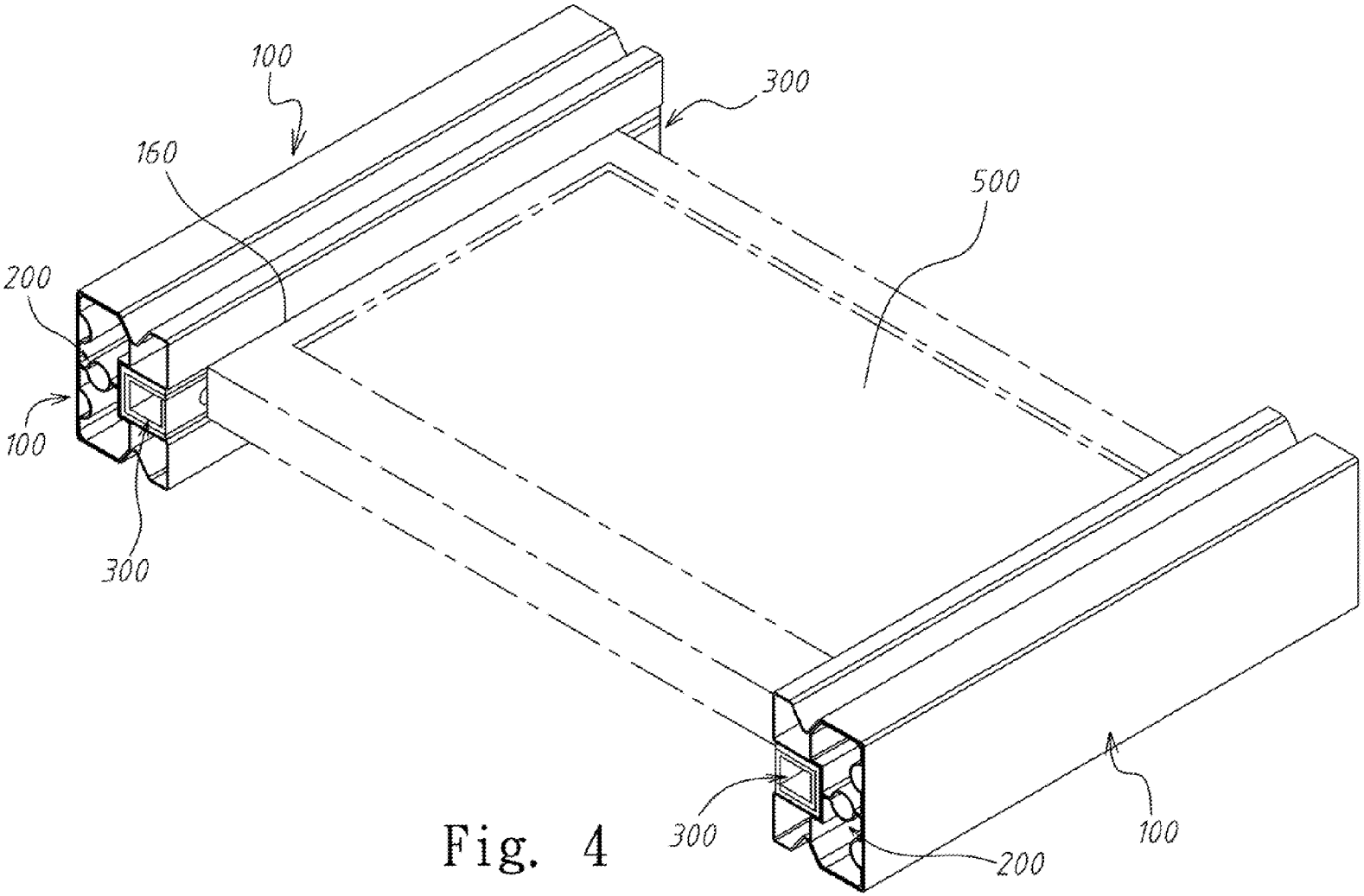
FIG. 4 shows the use of the buffer device of FIG. 2 in packaging an object.

Please refer to FIGS. 2 to 4. A buffer device providing reliable buffer effect according to a first embodiment of the present invention includes a channel-shaped buffer member 100 and at least one reinforcing tubular member 200. In implementing the present invention, the channel-shaped buffer member 100 and the reinforcing tubular member 200 is made of a paper material. However, it is understood the members 100, 200 can also be made using other suitable materials.

The channel-shaped buffer member 100 is a substantially U-sectioned hollow member and includes two facing inner sidewalls 110, two opposing outer sidewalls 120, an inner bottom wall 130, two outer top walls 140, and an outer bottom wall 150. The inner bottom wall 130 is connected at two opposite longitudinal edges to lower edges of the two inner sidewalls 110, so that an elongated channel 160 is formed between the inner bottom wall 130 and the two inner sidewalls 110 for receiving an edge portion of an object 500 to be protectively packaged, such as a screen panel, as shown in FIG. 4. The two outer top walls 140 are connected at respective inner longitudinal edge to upper edges of the two inner sidewalls 110 and at respective outer longitudinal edge to upper edges of the two outer sidewalls 120. The outer bottom wall 150 is connected at two opposite longitudinal edges to lower edges of the two outer sidewalls 120. The inner sidewalls 110, the outer sidewalls 120, the inner bottom wall 130, the outer top walls 140 and the outer bottom wall 150 together enclose and define a third buffer space 170 therein, so as to provide a buffer effect to protect the object 500.

The two outer sidewalls 120 respectively have a first curved buffer section 121 extended in a lengthwise direction of the channel-shaped buffer member 100, so as to give the channel-shaped buffer member 100 with an increased buffer effect.

The first reinforcing tubular member 200 is received in the third buffer space 170 in the channel-shaped buffer member 100. In the first embodiment illustrated in FIGS. 2 to 4, the first reinforcing tubular member 200 is more than one to include a left and a right reinforcing tubular member 200A, 200B. The left and right reinforcing tubular members 200A, 200B are received in the third buffer space 170 at two opposite left half space and right half space, respectively. To match a configuration of the left and right half spaces of the third buffer space 170, the left and the right reinforcing tubular members 200A, 200B are two substantially L-sectioned tubular members facing toward each other.

The left and the right reinforcing tubular member 200A, 200B respectively enclose a first buffer space 210 therein, and include a normal-direction supporting wall 220 extended between and pressed against the inner bottom wall 130 and the outer bottom wall 150 of the channel-shaped buffer member 100. Each of the normal-direction supporting walls 220 is provided with a second curved buffer section 221 extended in a lengthwise direction of the first reinforcing tubular members 200.

Please refer to FIGS. 3 and 4 at the same time. When it is desired to protectively package an object 500, such as a screen panel, with the buffer device of the present invention, two identical buffer devices according to the present invention are separately mounted to two opposite edge portions of the object 500, so that the edge portions of the object 500 are received in the elongated channels 160 of the two channel-shaped buffer members 100 and in contact with the inner bottom walls 130 thereof. The third buffer spaces 170 and the first curved buffer sections 121 provided by the channel-shaped buffer members 100 serve to buffer impact forces and compressing forces applied in a normal direction to the outer bottom walls 150. Particularly, with the normal-direction supporting walls 220 of the first reinforcing tubular members 200, including the left and the right tubular members 200A, 200B, extended between and pressed against the inner bottom walls 130 and the outer bottom walls 150 of the channel-shaped buffer members 100, the channel-shaped buffer members 100 can have increased normal-direction supporting strength and compression resistance to the forces applied normal to the outer bottom walls 150. Moreover, the first buffer spaces 210 in the first reinforcing tubular members 200 and the second curved buffer sections 221 on the normal-direction supporting walls 220 of the first reinforcing tubular members 200 further buffer the impact forces and compressing forces applied normal to the outer bottom walls 150. Thus, the buffer device according to the present invention can effectively and reliably provide the buffer function to protect the object 500 being packaged.

As can be seen in FIGS. 2 to 4, the left and the right reinforcing tubular member 200A, 200B further include a first horizontal supporting wall 230 each. The two first horizontal supporting walls 230 adjoin to each other at their longitudinal inner edges and have longitudinal outer edges separately pressed against the two outer sidewalls 120 of the channel-shaped buffer member 100. Moreover, the two first horizontal supporting walls 230 are respectively provided with a third curved buffer section 231 extended in a lengthwise direction of the left and the right reinforcing tubular member 200A, 200B. The first horizontal supporting walls 230 enable the channel-shaped buffer member 100 to have an increased horizontal supporting strength and compression resistance to forces applied normal to the two outer sidewalls 120. And, the third curved buffer sections 231 also further buffer impact forces and compressing forces applied normal to the two outer sidewalls 120.

As can be seen from FIGS. 2 and 4, the buffer device according to the first embodiment of the present invention further includes two stoppers 300, which can also be made of a paper material, for example. The two stoppers 300 are separately fixedly mounted to two opposite ends of the elongated channel 160 of the channel-shaped buffer member 100, so as to confine an edge portion of the protected object 500 in the elongated channel 160 without the risk of moving sidewardly between the two stoppers 300.

Figure 5:
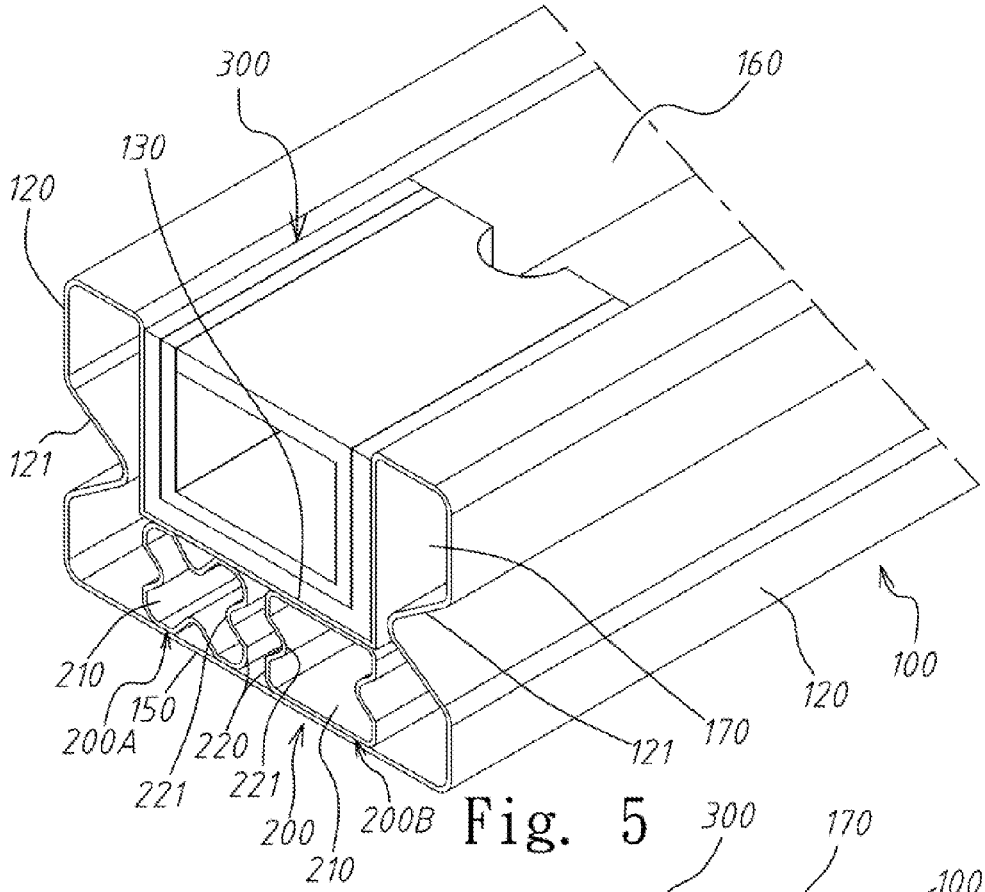
FIG. 5 is an assembled perspective view of a buffer device providing reliable buffer effect according to a second embodiment of the present invention.
Figure 6:
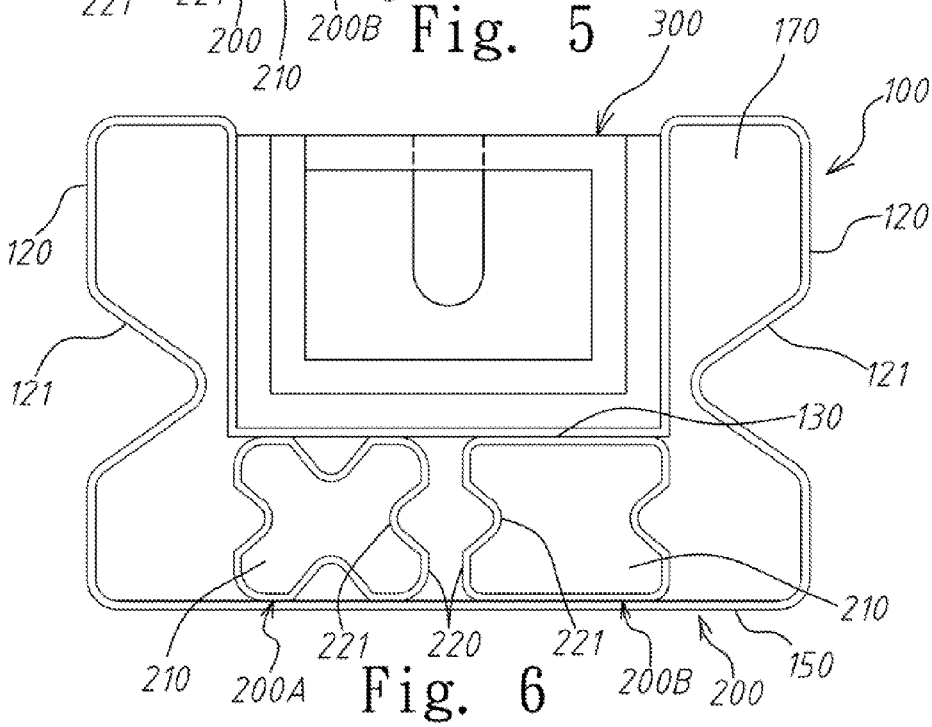
FIG. 6 is a sectioned end view of FIG. 5.

FIGS. 5 and 6 are assembled perspective view and sectioned end view, respectively, of a buffer device according to a second embodiment of the present invention. The second embodiment is structurally similar to the first embodiment, except for two first reinforcing tubular members 200 that include an X-sectioned left reinforcing tubular member 200A and a rectangular-sectioned right reinforcing tubular member 200B. However, the X-sectioned left reinforcing tubular member 200A and the rectangular-sectioned right reinforcing tubular member 200B provide the same buffer effect as the substantially L-sectioned left and right reinforcing tubular members 200A, 200B in the first embodiment. That is, each of the reinforcing tubular members in the second embodiment similarly encloses a first buffer space 210 therein and includes a normal-direction supporting wall 220 with a second curved buffer section 221, and the normal-direction supporting walls 220 are extended between and pressed against the inner bottom wall 130 and the outer bottom wall 150 of the channel-shaped buffer member 100. Therefore, the X-sectioned left reinforcing tubular member 200A and the rectangular-sectioned right reinforcing tubular member 200B not only enable the channel-shaped buffer member 100 to have increased normal-direction supporting strength, but also provide the function of buffering impact force and compressing force applied normal to the outer bottom wall 150.

Figure 7:
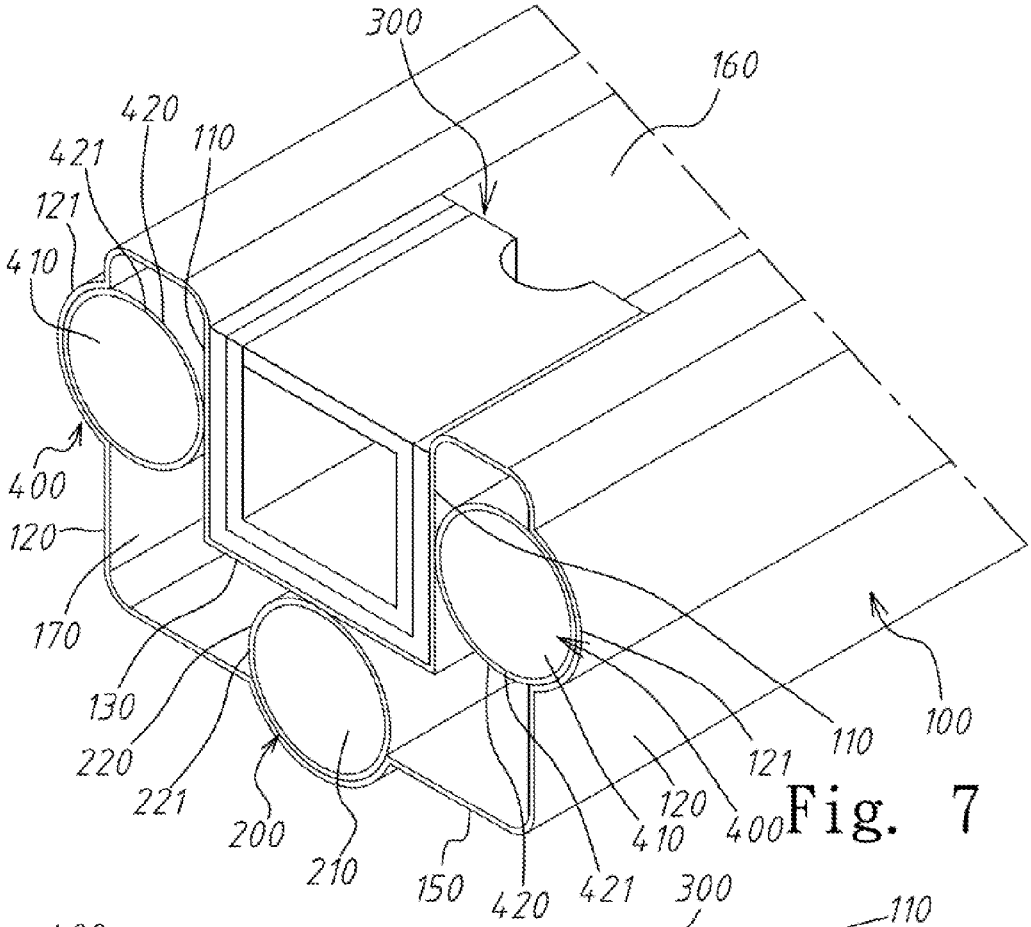
FIG. 7 is an assembled perspective view of a buffer device providing reliable buffer effect according to a third embodiment of the present invention.
Figure 8:
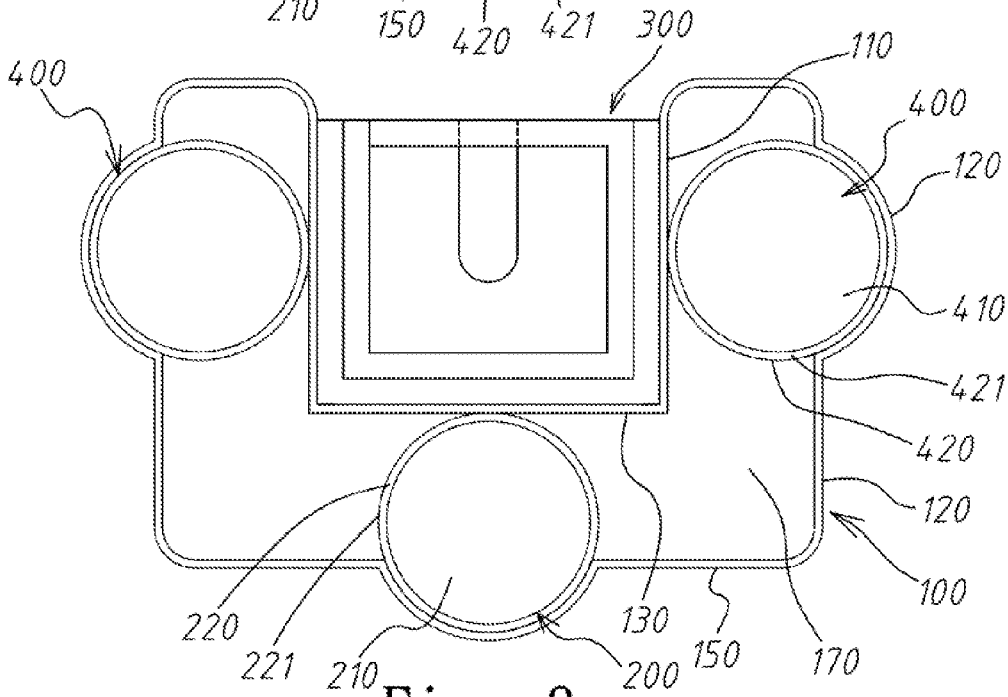
FIG. 8 is a sectioned end view of FIG. 7.

FIGS. 7 and 8 are assembled perspective view and sectioned end view, respectively, of a buffer device according to a third embodiment of the present invention. The third embodiment is structurally similar to the first embodiment, except for a single first reinforcing tubular member 200 that has a round cross section. However, the round-sectioned first reinforcing tubular member 200 provides the same buffer effect as the substantially L-sectioned tubular members 200 in the first embodiment. That is, the round-sectioned first reinforcing tubular member 200 in the third embodiment similarly encloses a first buffer space 210 therein and includes a normal-direction supporting wall 220 with a second curved buffer section 221, and the normal-direction supporting walls 220 are extended between and pressed against the inner bottom wall 130 and the outer bottom wall 150 of the channel-shaped buffer member 100. Therefore, the round-sectioned first reinforcing tubular member 200 not only enables the channel-shaped buffer member 100 to have increased normal-direction supporting strength, but also provides the function of buffering impact force and compressing force applied normal to the outer bottom wall 150.

In the third embodiment, there are further provided two opposite second reinforcing tubular members 400. In implementing the present invention, the second reinforcing tubular members 400 are made of paper material or other suitable materials. The second reinforcing tubular members 400 can be of any cross-sectional shape, such as round-sectioned tubular members. The second reinforcing tubular members 400 are received in the third buffer space 170 at two opposite sides of the elongated channel 160 to locate between two adjacent inner sidewall 110 and outer sidewall 120. Each of the second reinforcing tubular members 400 encloses a second buffer space 410 therein, and includes a second horizontal supporting wall 420 extended between and pressed against the adjacent inner sidewall 110 and outer sidewall 120. Each of the second horizontal supporting walls 420 has a fourth curved buffer section 421 extended in a lengthwise direction of the second reinforcing tubular member 400. The second reinforcing tubular members 400 and the second horizontal supporting walls 420 thereof enable the channel-shaped buffer member 100 to have increased horizontal supporting strength and compression resistance to forces applied normal to the two outer sidewalls 120. And, the fourth curved buffer sections 421 also further buffer impact forces and compressing forces applied normal to the two outer sidewalls 120.

With the above arrangements, the buffer device according to the present invention has a channel-shaped buffer member with increased normal-direction and horizontal supporting strength and enhanced buffer capacity, and can therefore stably and reliably provide the buffer function to protect an object being packaged with the buffer device. This advantage allows the buffer device of the present invention to have good applicability and usability to achieve the objects thereof.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A buffer device providing reliably buffer effect for mounting to an edge portion of an object to be protectively packaged, comprising:

a channel-shaped buffer member having:

two facing inner sidewalls;

two opposite outer sidewalls being respectively provided with at least one first curved buffer section extended in a lengthwise direction of the channel-shaped buffer member;

an inner bottom wall connected at two opposite longitudinal edges to lower edges of the two inner sidewalls, so that an elongated channel is formed between the inner bottom wall and the two inner sidewalls for receiving the edge portion of the object to be protectively packaged;

two outer top walls connected at respective inner longitudinal edge to upper edges of the two inner sidewalls and at respective outer longitudinal edge to upper edges of the two outer sidewalls; and an outer bottom wall connected at two opposite longitudinal edges to lower edges of the two outer sidewalls; and the two inner sidewalls, the two outer sidewalls, the inner bottom wall, the two outer top walls and the outer bottom wall together enclosing and defining a third buffer space therein; and at least one first reinforcing tubular member being received in the third buffer space; the first reinforcing tubular member enclosing a first buffer space therein and including at least one normal-direction supporting wall extended between and pressed against the inner bottom wall and the outer bottom wall of the channel-shaped buffer member; and the normal-direction supporting wall being provided with at least one second curved buffer section extended in a lengthwise direction of the first reinforcing tubular member.

2. The buffer device as claimed in claim 1, further comprising two stoppers being separately fixedly mounted to two opposite ends of the elongated channel of the channel-shaped buffer member.

3. The buffer device as claimed in claim 2, wherein the first reinforcing tubular member is a round-sectioned tubular member.

4. The buffer device as claimed in claim 2, wherein the first reinforcing tubular member is more than one to include a left and a right reinforcing tubular member, and the left and right reinforcing tubular members being received in the third buffer space to respectively locate in two opposite left half space and right half space of the third buffer space.

5. The buffer device as claimed in claim 4, wherein the left and the right reinforcing tubular member are respectively an X-sectioned and a rectangular-sectioned tubular member.

6. The buffer device as claimed in claim 4, wherein the left and the right reinforcing tubular member respectively include at least one first horizontal supporting wall;

the first horizontal supporting walls on the left and right reinforcing tubular members adjoining to each other at their longitudinal inner edges and having longitudinal outer edges separately pressed against the two outer sidewalls of the channel-shaped buffer member; and, the two first horizontal supporting walls being respectively provided with at least a third curved buffer section extended in a lengthwise direction of the left and the right reinforcing tubular member.

7. The buffer device as claimed in claim 6, wherein the left and the right reinforcing tubular member are two substantially L-sectioned tubular members.

8. The buffer device as claimed in claim 2, further comprising two opposite second reinforcing tubular members received in the third buffer space at two opposite sides of the elongated channel to locate between two adjacent inner sidewall and outer sidewall; each of the second reinforcing tubular members enclosing a second buffer space therein and including a second horizontal supporting wall extended between and pressed against the adjacent inner sidewall and outer sidewall; and each of the second horizontal supporting walls having a fourth curved buffer section extended in a lengthwise direction of the second reinforcing tubular member.

9. The buffer device as claimed in claim 8, wherein the second reinforcing tubular members are round-sectioned tubular members.

* * * * *